United States Patent [19]

Vigar

[11] 4,293,620

[45] Oct. 6, 1981

[54] PROCESS FOR THE DEPOSITION OF THICK CHROMIUM FILMS FROM TRIVALENT CHROMIUM PLATING SOLUTIONS AND ARTICLE SO PRODUCED

[75] Inventor: James M. L. Vigar, Winchester, England

[73] Assignee: International Business Machines Corporation, Armonk, N.Y.

[21] Appl. No.: 157,714

[22] Filed: Jun. 9, 1980

[30] Foreign Application Priority Data

Jun. 29, 1979 [GB] United Kingdom ..... 22791/79

[51] Int. Cl.[3] ..... C25D 3/06; C25D 5/12; C25D 5/14

[52] U.S. Cl. ..... 428/667; 204/41; 204/51

[58] Field of Search ..... 204/41, 51, 43 R; 428/664, 666, 667

[56] References Cited

U.S. PATENT DOCUMENTS

| | | | |
|---|---|---|---|
| 4,062,737 | 12/1977 | Barclay et al. | 204/43 R |
| 4,141,803 | 2/1979 | Barclay et al. | 204/51 |
| 4,161,432 | 7/1979 | Barclay et al. | 204/51 |

FOREIGN PATENT DOCUMENTS

| | | | |
|---|---|---|---|
| 1431639 | 4/1976 | United Kingdom | 204/43 R |

*Primary Examiner*—G. L. Kaplan
*Attorney, Agent, or Firm*—Francis A. Sirr

[57] ABSTRACT

A process for plating thick chromium coatings for engineering applications comprises depositing a thin initial layer from a low concentration chromium III/thiocyanate bath and depositing the bulk of the remaining thickness from a relatively higher concentration chromium III/thiocyanate bath. Deposits produced by this two-stage process are more cohesive and smoother than those obtainable by plating the entire thickness from the high concentration bath alone.

10 Claims, No Drawings

PROCESS FOR THE DEPOSITION OF THICK CHROMIUM FILMS FROM TRIVALENT CHROMIUM PLATING SOLUTIONS AND ARTICLE SO PRODUCED

TECHNICAL FIELD

This invention relates to the deposition of thick films from chromium electroplating solutions in which the source of chromium comprises an aqueous solution of a chromium (III)—thiocyanate complex. In this context, the term "thick film" means a film of greater than five microns thickness.

BACKGROUND ART

Conventionally, chromium has been plated from aqueous chromic acid baths prepared from chromic oxide ($CrO_3$) and sulphuric acid. Such baths, in which the chromium is in hexavalent form, are characterized by low current efficiency. The chromic acid fumes emitted as a result of hydrogen evolution also present a considerable health hazard. Furthermore, the concentration of chromium in such baths is extremely high, leading to problems of waste or recovery because of so-called "drag-out" of chromium compounds into the rinse tanks which follow the plating bath.

To overcome many of the disadvantages of hexavalent chromium plating, it has been proposed to plate chromium in trivalent form. One such process for plating chromium from an aqueous solution of a chromium (III)—thiocyanate complex is described in UK Pat. No. 1,431,639 and its equivalent U.S. Pat. No. 4,062,737. Another such process is described in out UK patent application No. 24734/77 and its equivalent U.S. Pat. No. 4,161,432 which describes a chromium plating solution and process in which an aqueous solution of a chromium (III)—thiocyanate complex is again employed but in which a buffer material supplies one of the ligands to the chromium complex. The buffer material is selected from amino acids (e.g., glycine, aspartic acid), peptides, formates, acetates and hypophosphites.

These trivalent chromium plating processes do not give off chromic acid fumes. They are of high efficiency with a wide plating range and good covering power. A very much lower amount of chromium is needed in the bath than is the case with hexavalent processes, thus reducing the problems associated with "drag-out". Concentrations of chromium have ranged from 0.30 to 0.5 Molar.

Although the trivalent chromium plating processes of UK Pat. 1,431,639 and UK patent application No. 24734/77 overcome all the major disadvantages of hexavalent plating, the appearance of the deposited chromium is generally somewhat darker. While this color is quite acceptable or even preferable for many applications, it is advantageous to be able to plate lighter colored chromium with a trivalent process. In UK patent application 44177/78, chromium (III)—thiocyanate baths are disclosed whose chromium concentration is far below the generally accepted level for efficiency and bath stability. Such baths give a significantly lighter colored deposit. The concentration of chromium in these baths is less than 0.03 M and preferably less than 0.015 M.

DISCLOSURE OF THE INVENTION

Chromium plating, besides its decorative applications, is also used for engineering purposes. Because of its hardness, low friction and corrosion resistance, it is used to provide, for example, a wear resistant coating on the surface of a sliding machine part or to provide such a coating on screws or bolts. For such applications, it is generally necessary that the thickness of the plated chromium be very much greater than in decorative applications. Typically, decorative chromium is less than one micron in thickness whereas "engineering" chromium needs to be of the order of tens of microns thickness. Such thicknesses have hitherto been achievable only with hexavalent chromium plating. Attempts to plate thick chromium (above 5 microns) from trivalent baths such as those of UK Pat. No. 1,431,639 and UK patent application No. 24734/77 have resulted in coarse, matt deposits with poor cohesion.

The present invention provides a process of electroplating an article with a layer of chromium exceeding five microns in thickness comprising the step of electroplating the article with an initial relatively thin layer of chromium from an equilibrated aqueous solution of a chromium (III)—thiocyanate complex of relatively low chromium concentration, and plating the major proportion of the remaining thickness in one or more steps from an equilibrated aqueous solution of a chromium (III)—thiocyanate complex of relatively higher concentration.

The invention is based on the discovery that if an initial thin layer is deposited from a dilute Cr (III)—thiocyanate bath, subsequent thick deposits from a more concentrated, higher rate Cr (III)—thiocyanate bath have much better properties of cohesion and surface smoothness. Preferably, the low concentration is less than 0.03 Molar. In this preferred process, only the initial thin layer is deposited from the lower concentration solution, the entire remaining thickness being plated from more concentrated solution.

Alternatively, alternate thick and thin layers may be plated from the higher and lower concentration baths respectively.

The preferred thickness of the initial thin layer is less than 1000 Angstroms.

The preferred chromium plating solutions include an amino acid as a buffer material, providing at least one of the ligands for the complex.

The preferred current densities are in the range 40–50 mA $cm^{-2}$ for the inital layer plating step and 50–120 mA $cm^{-2}$ for the concentrated solution plating step.

DETAILED DESCRIPTION OF THE INVENTION

In plating thick chromium according to the invention, chromium has been plated onto standard steel test panels in thicknesses ranging from 10–75 microns. The steel test panels were, in some cases, first plated with bright nickel to a thickness of 10–12 microns.

Chromium seeding layers were plated from a bath having 0.003 M chromium concentration to a thickness of not more than 1000 Angstroms. Further, chromium was deposited from a bath having 0.1 M chromium concentration. In some cases, deposition of the seeding layer was followed by a single plating step from the 0.1 M bath to deposit the remainder of the film. In other cases, a few microns from the 0.1 M bath were alternated with a flash layer from the 0.003 M bath.

A comparative example was plated from the 0.1 M bath alone and found to have a surface profile center line average (CLA) of 75 microinches. The CLA's of the samples plated according to the invention were much lower, down to seven microinches.

ESCA measurements of the deposit indicate that the low concentration chromium is very pure whereas the high concentration chromium deposit includes chemically bound oxygen and sulphur. It is believed that, since the initial thin layer is very pure and uniform, it acts as a seeding layer for the remainder of the deposit which limits its granularity. The overall thick film is thus more cohesive and less friable than films of the same thickness deposited from the higher concentration bath alone. The light color of the deposited chromium from low concentration baths, as described in UK patent application No. 44177/78, may also be related to purity. Conversely, the entire range of low chromium concentration baths disclosed in that application is expected to be beneficial in depositing thick films of chromium. This range was 0.0002–0.025 M, with a postulated upper limit of 0.03 M.

The invention will now be described further with reference to the following examples:

COMPARATIVE EXAMPLE I

A relatively high concentration of trivalent chromium plating solution was prepared in the following manner:

(a) 60 grams of boric acid ($H_3BO_3$) were added to 750 ml of deionized water which was then heated and stirred to dissolve the boric acid.

(b) 33.12 grams of chromium sulphate ($Cr_2(SO_4)_3.15H_2O$) and 32.43 grams of sodium thiocyanate (NaNCS) were added to the solution, which was then heated and stirred at approximately 70° C. for about 30 minutes.

(c) 13.3 grams of DL aspartic acid ($NH_2CH_2CH(COOH)_2$) were added to the solution which was then heated and stirred at approximately 70° C. for about 3 hours. During this time, the pH was adjusted from pH 1.5 to pH 2.8 very slowly with 10% by weight sodium hydroxide solution. Once the pH of 2.8 was achieved, it was maintained at this value for the whole of the equilibration period.

(d) Sufficient sodium chloride was added to the solution to make it approximately 1 M concentration and 0.1 grams of FC 98 (a wetting agent produced by 3 M Corporation) was also added. The solution was heated and stirred for an additional 30 minutes.

(e) The solution pH was again adjusted to pH 2.8 with a sodium hydroxide solution.

(f) The solution was made up to one liter with deionized water which had been adjusted to pH 3.0 with 10% by volume of hydrochloric acid.

The final solution is of the following composition:

0.1 M chrome sulphate—$Cr_2(SO_4)_3.15H_2O$;
0.4 M sodium thiocyanate—NaNCS;
0.1 M aspartic acid—$NH_2CH_2CH(COOH)_2$;
60 g/l boric acid—$H_3BO_3$;
60 g/l sodium chloride—NaCl; and
0.1 g/l FC 98 wetting agent.

This electroplating solution was introduced into a plating cell. A platinised titanium anode and a steel sample panel was cathode were immersed in the cell. The steel panel had an overcoating of 10–12 microns of bright nickel. A plating current of 75 mA $cm^{-2}$ was passed between the electrodes for 90 minutes. A layer of chromium of 20.9 microns thickness was deposited.

EXAMPLE I

A second lower concentration chromium plating solution was made up as follows. A solution was prepared in exactly the same manner as described in Comparative Example I except that one-half the quantity of sodium thiocyanate was used, resulting in a sodium thiocyanate concentration of 0.2 M. 30 mls of this solution were made up to one liter with a solution containing 60 grams per liter of boric acid and 60 grams per liter of sodium chloride.

The final lower concentration solution had essentially the following composition;

0.003 M chrome sulphate;
0.006 M sodium thiocyanate;
0.003M aspartic acid; 60 g/l boric acid; and
60 g/l sodium chloride.

The lower concentration electroplating solution was introduced into a plating cell having a platinized titanium anode and a steel sample panel as cathode. A plating current of 40 mA $cm^{-2}$ was passed through the cell for 240 seconds to deposit an initial layer of chromium estimated to be not more than 1000 Angstroms in thickness.

The panel was then transferred without rinsing to a second plating cell containing a higher concentration chromium electroplating solution of the same composition as that of Comparative Example I. A plating current of 75 mA $cm^{-2}$ was passed through the cell for 180 minutes to deposit a much thicker layer of chromium on top of the initial thin layer. The final thickness of the chromium layer was 21.6 microns.

This thick layer appeared smooth and reflective to the eye. The CLA of the surface was seven microinches (0.178 microns). The deposit was less friable and more cohesive than that of Example I.

EXAMPLE II

The process of Example I was repeated in a series of experiments using the same two plating solutions, although in some cases the wetting agent was omitted. This appeared to improve the characteristics of the deposit even further by reducing granularity. Films ranging from 10 to 75 microns thickness were plated. Current densities for plating from the low concentration bath were in the range 40–50 mA $cm^{-2}$. Current densities for plating from the high concentration bath were in the range 50–120 MA $cm^{-2}$.

CLA measurements on some of these samples lay in the range 7–11.2 microinches.

EXAMPLE III

Using the same solutions as for Example I, and starting with the lower concentration solution, alternate layers of chromium were deposited on a steel sample panel from the two solutions.

The steel panel was first connected as cathode in the low concentration bath and a current density 40 MA $cm^{-2}$ was passed for 240 seconds to produce a thin initial layer of chromium of no more than 1000 Angstroms thickness. The panel was transferred, without rinsing, to the high concentration bath and plated at a current density of 50 MA $cm^{-2}$ for 30 minutes to produce a thicker layer of chromium. The panel was then transferred back to the low concentration bath and plated for 2 minutes at 40 mA $cm^{-2}$. The alternate plating for 30 minutes in the high concentration bath and 2 minutes in the low concentration bath was continued for a total time of 215 minutes.

In all a thickness of 16.9 microns of chromium was deposited. The final deposit was cohesive, smooth and nonfriable and had a CLA of 8 microinches (0.2 microns).

Having thus described my invention, what I claim as new and desire to secure by Letters Patent is:

1. A process of electroplating an article with a layer of chromium exceeding five microns in thickness comprising the step of electroplating the article with an initial relatively thin layer of chromium from a first equilibrated aqueous solution of chromium (III)—thiocyanate complexes of relatively low chromium concentration of about 0.003 M, and plating the major proportion of the remaining thickness in one or more steps from a second equilibrated aqueous solution of chromium (III)—thiocyanate complexes of relatively higher concentration of about 0.1 M.

2. A process of claim 1 wherein the entire remaining thickness after plating of the initial thin layer is plated from the more concentrated solution.

3. A process of claim 1 wherein the remaining thickness of the chromium layer is plated alternately from the high and low concentration solutions in thick and thin layers respectively.

4. A process of claim 1 wherein the initial relatively thin layer plating is terminated after deposition of a layer whose thickness is less than 1000 Angstroms.

5. A process of claim 1 wherein the electroplating solutions each include an amino acid as a buffer material providing at least one of the ligands for the complex.

6. A process of claim 1 wherein the solutions include a wetting agent.

7. A process of claim 1 wherein the current density while the initial thin layer is being plated is in the range 40–50 mA $cm^{-2}$.

8. A process of claim 1 wherein the current density during plating from the more concentrated solution is in the range 50–120 mA $cm^{-2}$.

9. An article plated by a process as claimed in claim 1.

10. A process of electroplating an article with a layer of chromium exceeding five microns in thickness comprising the step of electroplating the article with an initial relatively thin layer of chromium from an equilibrated aqueous solution of chromium (III)—thiocyanate complexes of a relatively low chromium concentration less than 0.03 M, and plating the major proportion of the remaining thickness in one or more steps from an equilibrated aqueous solution of chromium (III)—thiocyanate complexes of a relatively high chromium concentration greater than 0.03 M;

the relatively low concentration solution comprising:
0.003 M chrome sulphate;
0.006 M sodium thiocyanate;
0.003 M aspartic acid;
60 g/l boric acid; and
60 g/l sodium chloride; and the relatively high concentration solution comprising:
0.1 M chrome sulphate;
0.4 M sodium thiocyanate;
0.1 M aspartic acid;
60 g/l boric acid; and
60 g/l sodium chloride.

* * * * *